US006357082B1

(12) United States Patent
Daoud

(10) Patent No.: US 6,357,082 B1
(45) Date of Patent: Mar. 19, 2002

(54) RESTRAINT MECHANISM FOR LIMITING ANGULAR ROTATION OF HINGED COMPONENTS

(75) Inventor: Bassel H. Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/399,017

(22) Filed: Sep. 21, 1999

(51) Int. Cl.[7] ..... E05D 11/06
(52) U.S. Cl. ..... 16/374; 16/375
(58) Field of Search ..... 16/374, 375, 377; D8/402

(56) References Cited

U.S. PATENT DOCUMENTS

| | | | | | |
|---|---|---|---|---|---|
| 217,174 | A | * | 7/1879 | Turton | 16/375 |
| 2,813,294 | A | * | 11/1957 | Civitelli | 16/375 |
| 3,187,372 | A | * | 6/1965 | Parsons | 16/375 |
| 3,425,386 | A | * | 2/1969 | Cambell | 16/375 |
| 3,913,171 | A | * | 10/1975 | Reid | 16/375 |
| D251,585 | S | * | 4/1979 | Coutts | D8/402 |
| 4,998,941 | A | * | 3/1991 | Smith | 16/374 |
| 5,027,471 | A | * | 7/1991 | Barnes | 16/374 |
| 5,727,289 | A | * | 3/1998 | Reder | 16/375 |

* cited by examiner

*Primary Examiner*—Anthony Knight
*Assistant Examiner*—Mark Williams
(74) *Attorney, Agent, or Firm*—Hedman & Costigan, P.C.

(57) ABSTRACT

A restraint mechanism for limiting the angular rotation of a first and a second component which move about a common hinge comprising a restraining arm adapted to extend along a portion of the first component in the direction of the hinge and having a change of direction away from the hinge, and an attachment member for attaching the restraint mechanism to said first component.

14 Claims, 8 Drawing Sheets

RESTRAINT MECHANISM FOR LIMITING ANGULAR ROTATION OF HINGED COMPONENTS

FIELD OF THE INVENTION

The present invention relates to the field of mechanical devices for limiting angular rotation of members connected by a hinge or pivot.

BACKGROUND OF THE INVENTION

It is often desirable to define the relationship between two members which move with respect to one another about a hinge or pivot by limiting the allowed movement. One such situation arises in the case of a box having a top attached to a base by a hinge where the top moves in relation to the base. An especially significant example is an electrical or fiber optic box which has hook type hinges for quick engagement and disengagement when the singed members are in their fully open configuration.

The hook type hinge is used because it makes fabrication quick and easy. The hinge consists of a rod that is captured by a corresponding U-shaped member by clicking into place when the hinge is in the fully open position. Unfortunately, the hinge is just as easily disengaged when the box is in its fully open position.

Moreover, care must be taken with wires that pass from the top of the box to the base when opening the box to prevent damage to the wires or cable which may have a minimum bend radius.

SUMMARY OF THE INVENTION

The present invention is directed to a restraint mechanism for limiting the angular rotation between a first component and a second component which move about a common hinge comprising a restraining arm adapted to extend along a portion of the first component in the direction of the hinge and having a change of direction away from the hinge, and an attachment member for attaching the mechanism to said first component.

Preferably, the mechanism includes a base from which the restraining arm originates and a retention arm originating from the opposite side of the base from the restraining arm. The retention arm has a change of direction toward the hinge to create a D-shaped configuration with the restraining arm, having an opening for accepting wires or the like within the arms of the mechanism.

BRIEF DESCRIPTION OF THE DRAWINGS

The attached drawings, in which like reference characters represent like parts, are included to better illustrate the preferred embodiment of the present invention, without limiting the invention, wherein.

DETAILED DESCRIPTION OF THE PREFERRED EMBODIMENT

Figure 1:
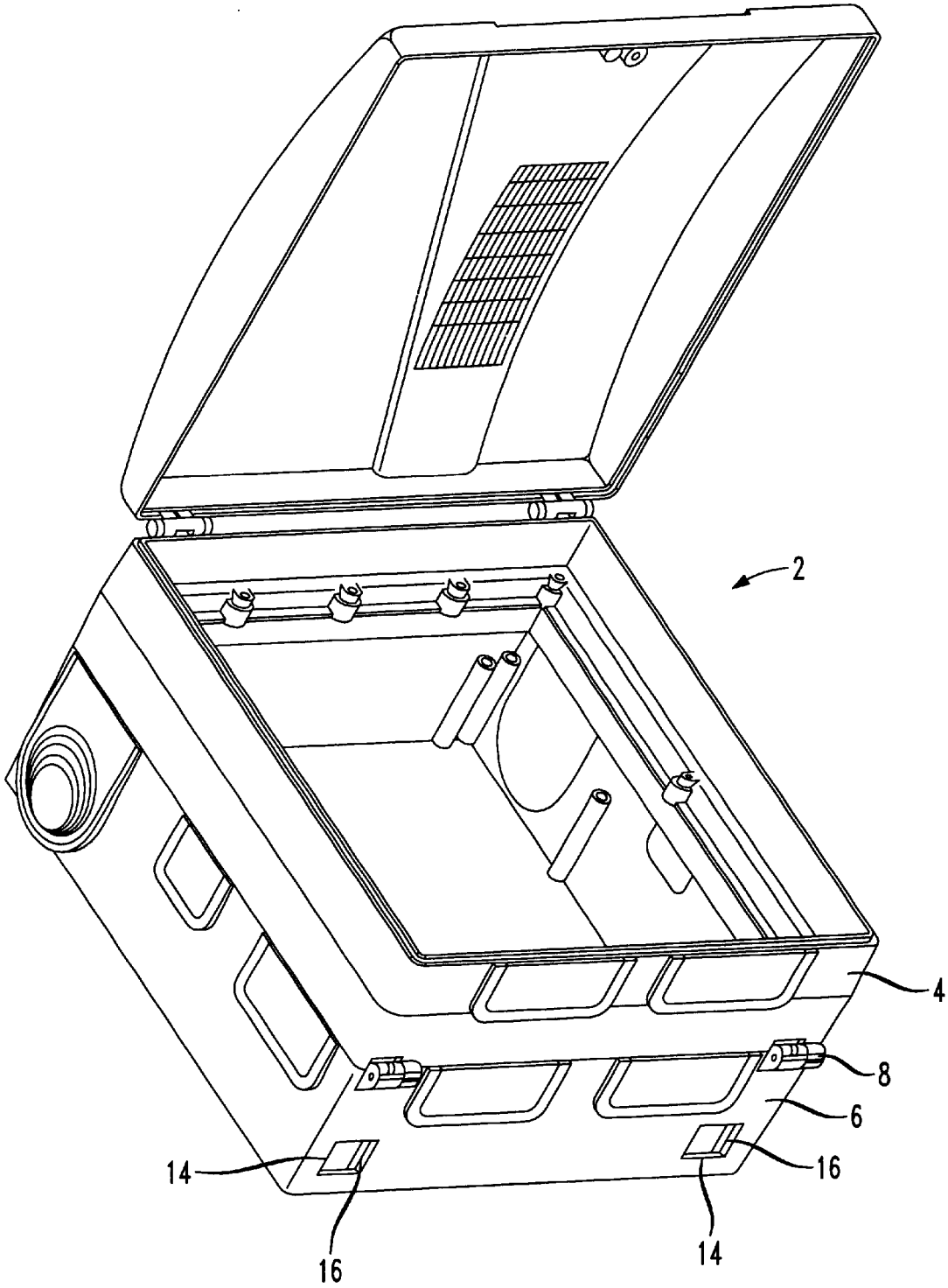
FIG. 1 is a perspective view of an electrical box suitable for use with the present invention.

A standard electrical box 2 as shown in FIG. 1, generally made of metal or high impact plastic, has two, three (as shown) or more hinged components for access to the wires, connections and devices therein. For purposes of this description, the two components 4 and 6 which move relative to a hinge 8 will be referred to.

Figure 2:
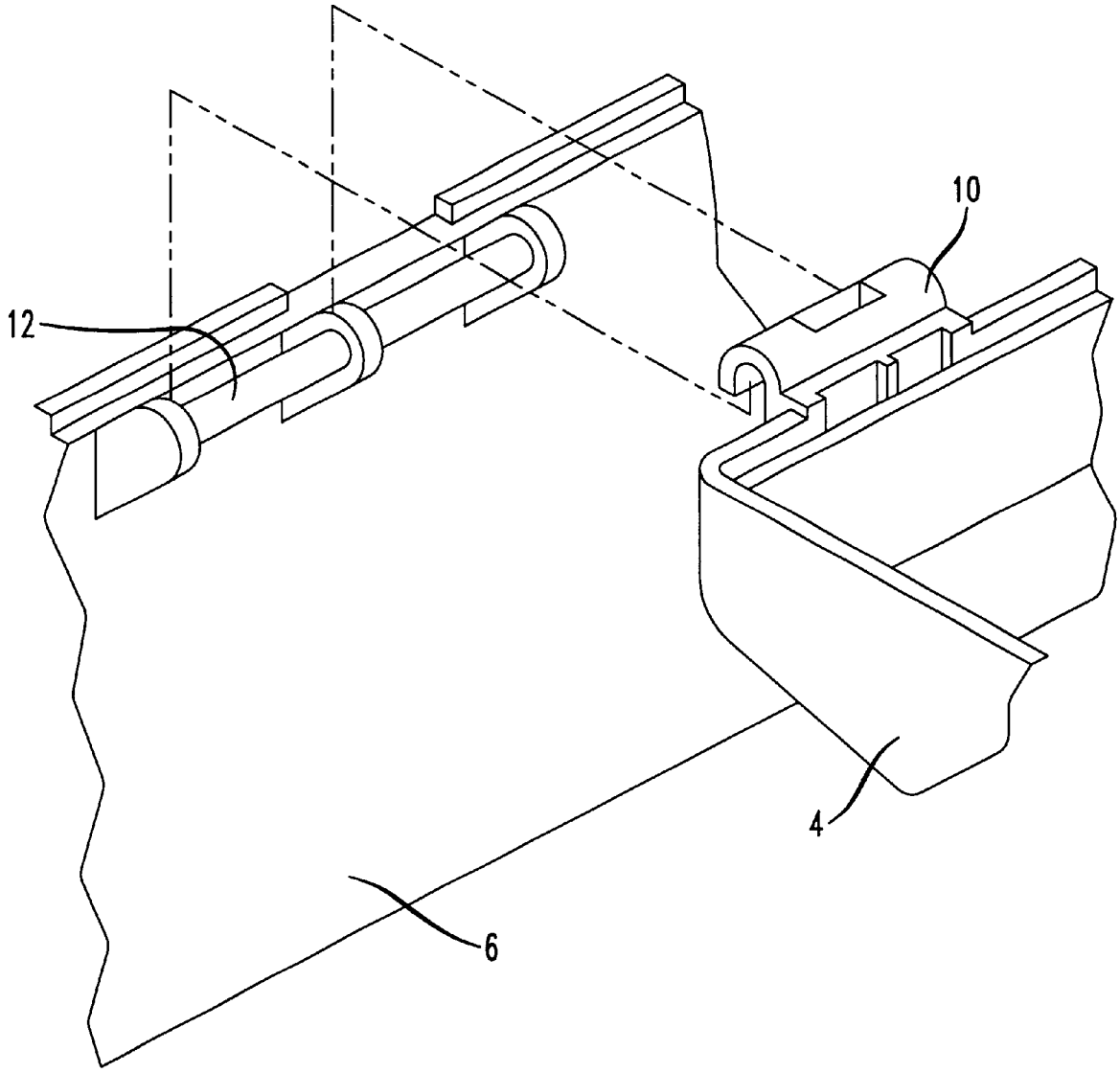
FIG. 2 is a partial perspective view of an exemplary hinge which provides quick assembly/release at a specific angle.

Hinges 8 for these types of electrical boxes 2 have been simplified for field assembly by providing easy attachment/release of two corresponding hinge elements 10 and 12. As shown in FIG. 2, the first component 4 includes a first hinge element 10 formed as a U-shaped member, the opening of which fits over a rod shaped member 12 included on the second component 6.

Figure 3:
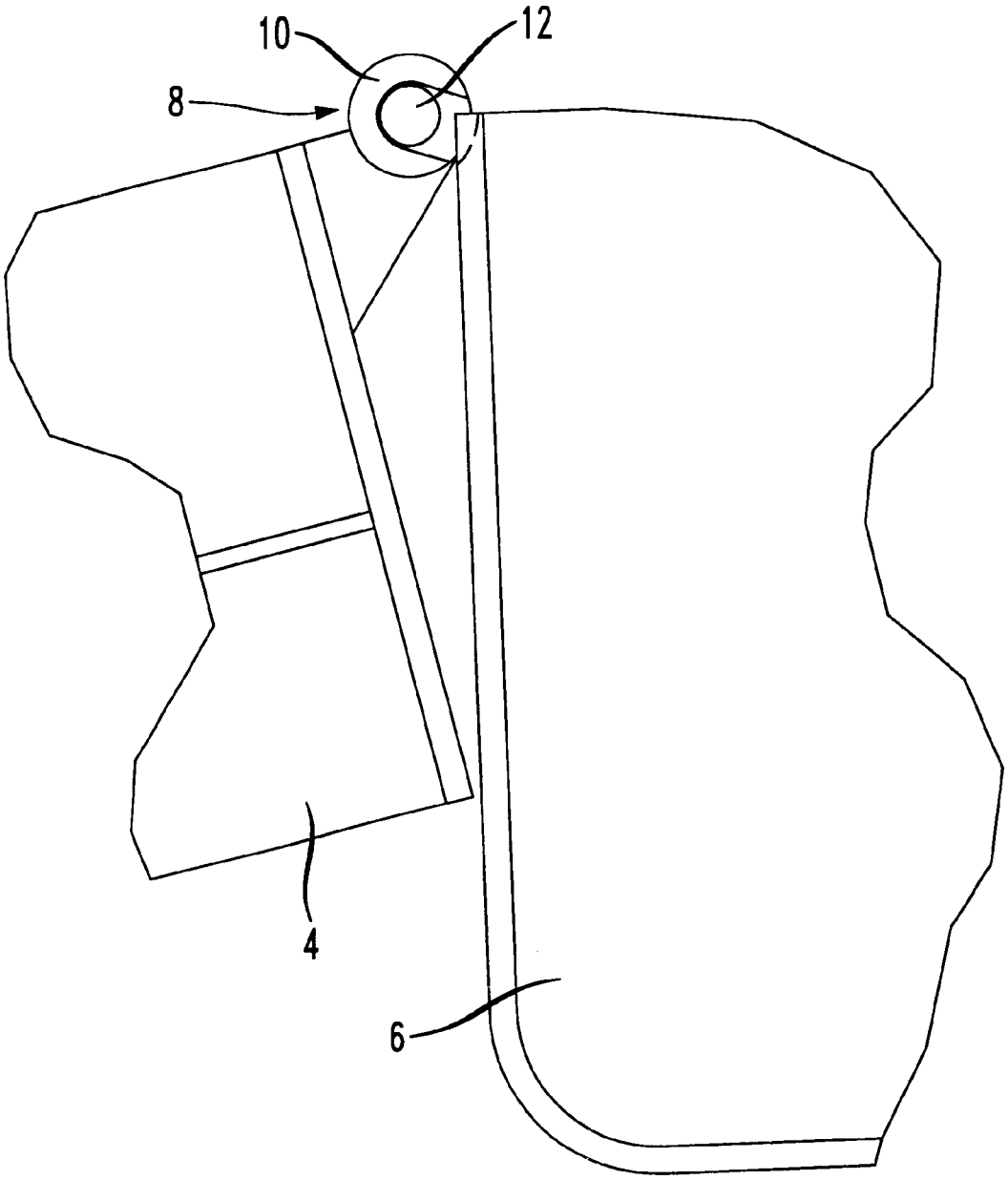
FIG. 3 is a partial side elevation of the hinged components of a box in its fully opened configuration.

To control unwanted release of the hinge members 10 and 12 the U-shaped member 10 is positioned in such a way that it can only be released from the rod member 12 when the components 4 and 6 are in their fully open configuration, as shown in FIG. 3. Otherwise, the open portion of the U-shaped member 10 is restricted from moving off of the rod by the closed portion of the U-shaped member 10 hitting the body of the second component 6.

Of course, the particular hinge 8 is not important to the present invention. However, the restraint mechanism 20 of the present invention is particularly useful when used on a box with hinges 8 that only release at the fully open configuration. This is because the restraint mechanism 20 prohibits the components from reaching the fully open configuration when properly engaged.

Figure 4:
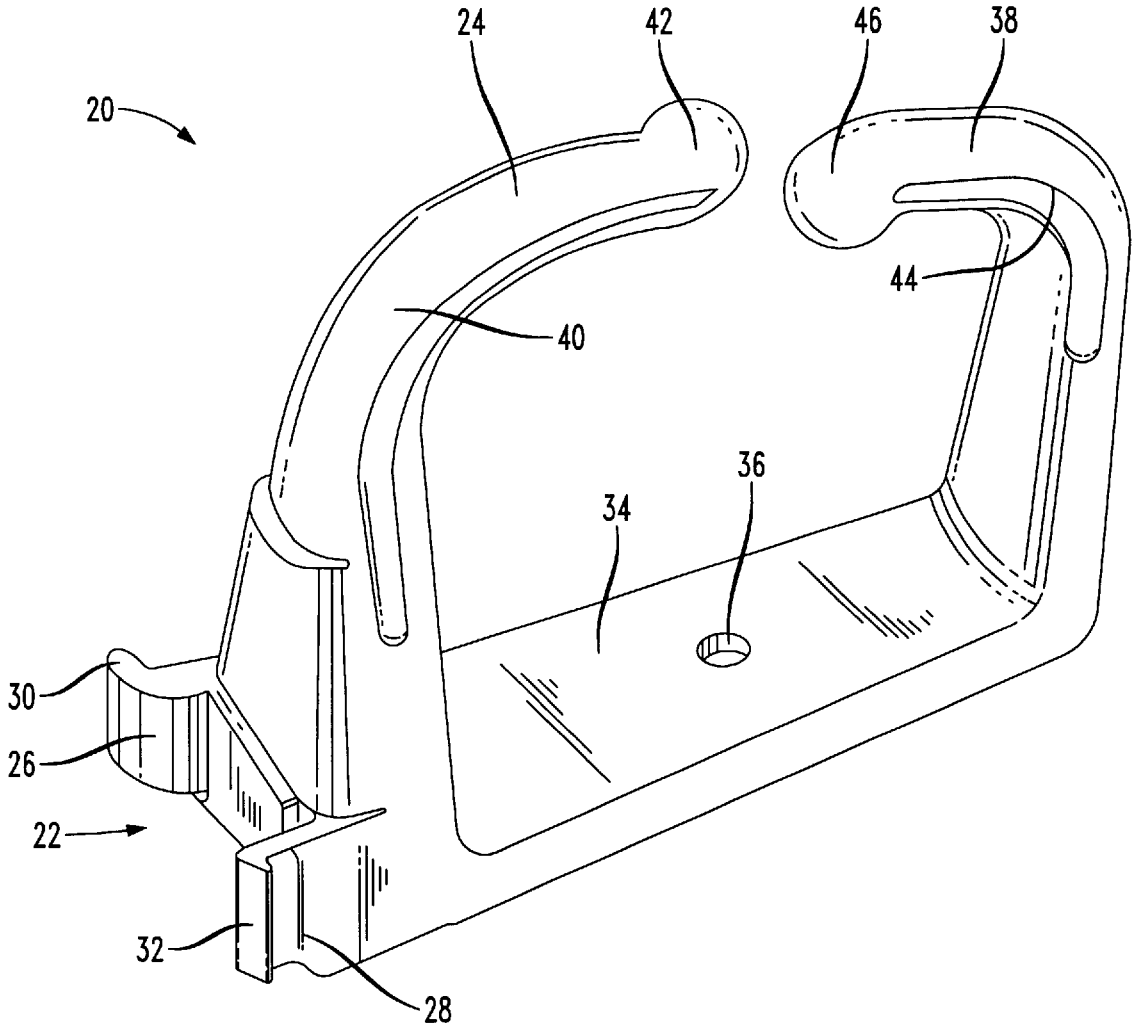
FIG. 4 is a perspective view of the preferred restraint mechanism of the present invention.
Figure 5:
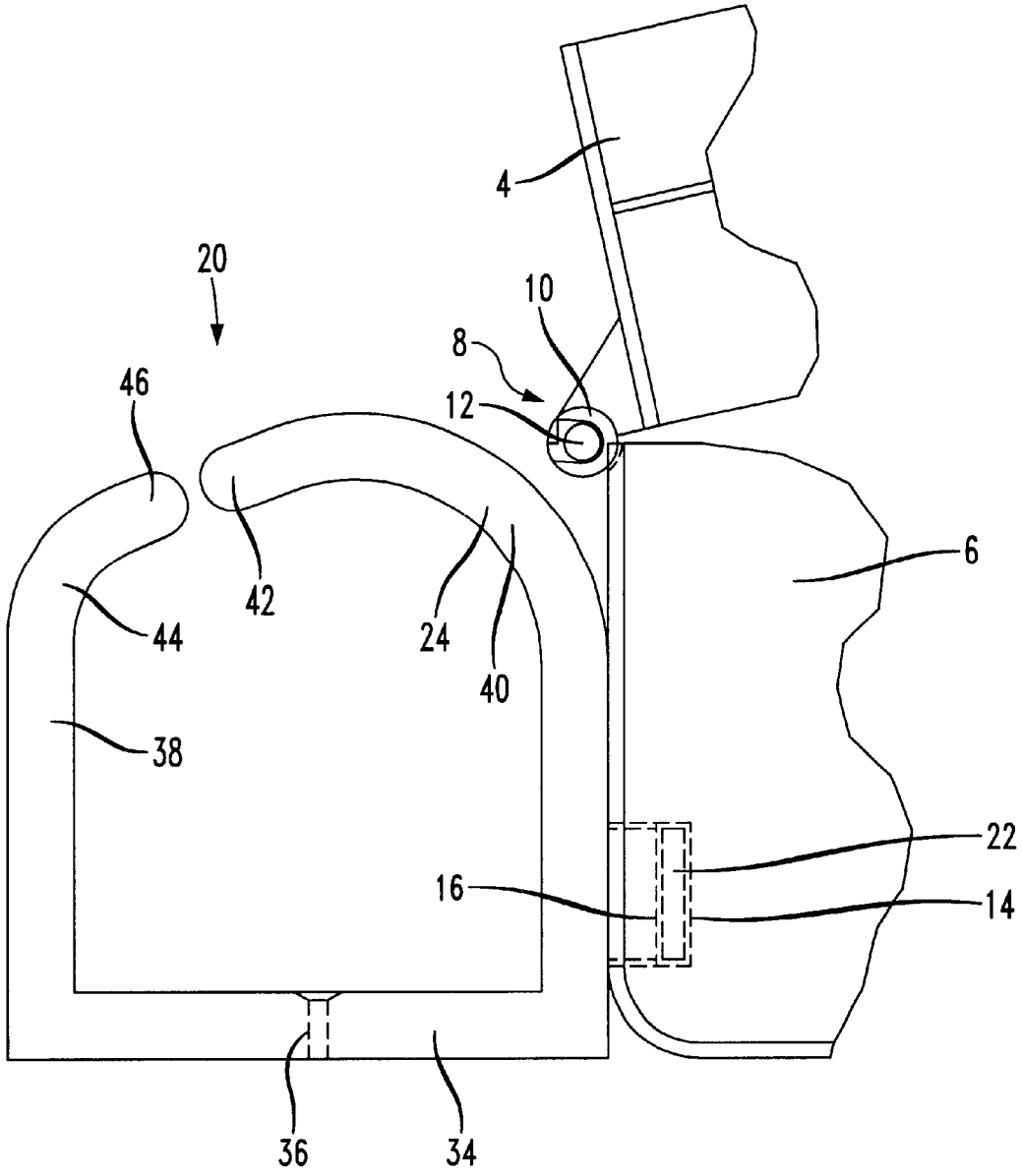
FIG. 5 is a partial side elevation of the hinged components with the preferred restraint mechanism of the present invention mounted on one of the components.

The restrain, mechanism 20 of the present invention, as shown in FIGS. 4 and 5, includes an attachment member 22 and a restraining arm 24 for stopping the angular rotation of the first and second components 4 and 6 of the box 2. The restraining arm 24 extends from its connection to the box 2 along a portion of the second component 6 and turns away from the hinge 8.

Figure 6:
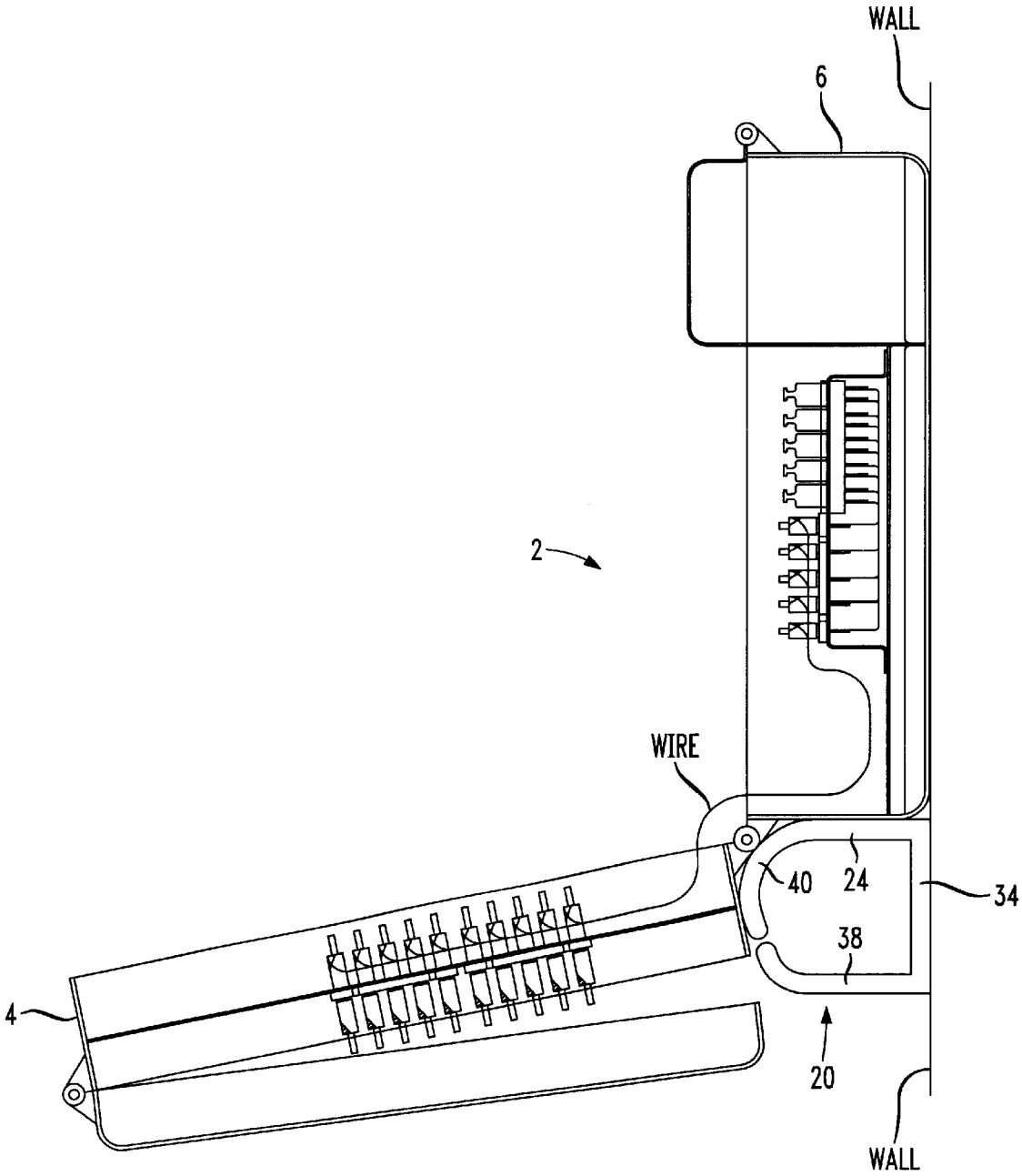
FIG. 6 is a side elevation of the open box with the preferred restraint mechanism of the present invention limiting the rotation of the hinged components of the box.

Preferably, the turn comprises a radial bend 40 which is contained within the hinge 8 as shown in FIGS. 5 and 6. It is also preferred that the end of the restraining arm 24 extend through an arc greater than 90° to a terminal end 42, the angle of which most preferably depending on the preferred angle of the components 4 and 6 when in the open and restrained position shown in FIG. 6. Moreover, the arm 24 is preferably flexible to provide some give when the top 4 contacts the restraining arm 24.

The preferred attachment member 22 includes two extensions 26 and 28 having opposed outwardly extending catches 30 and 32 thereon. The attachment member 22 corresponds with a receiver 14 in the base 6 of the box 2 where the catches 30 and 32 of the attachment member 22 releasably engage shelves 16 in the receiver 14. One of the extensions 26 is placed in the receiver 14 and the restraint mechanism 20 rotated until the other extension 28 enters the receiver 14 and the catch 32 clicks over the shelf 16.

Of course, any other known or later developed attachment members 8 could be used. These include such known physical connections as a receiving channel and a corresponding "T" or "L"-shaped extension where the extension slides into the channel to hold the pieces together. In such an embodiment, it does not matter whether the extension resides on the restraint mechanism 20 or on the component 6 of the box 2. Similarly, a screw and corresponding threads can be used for the mechanism 20 to be screwed onto the box 2. Alternatively, a snap with corresponding receptacle, a key with corresponding keyway or a dog can be used without deviating from the invention.

More permanent mounting can be used, including epoxy, adhesives, double sided tape and the like materials. However, it is preferred that removable means be employed to provide for later disassembly of the components 4 and 6 if desired.

Figure 7:
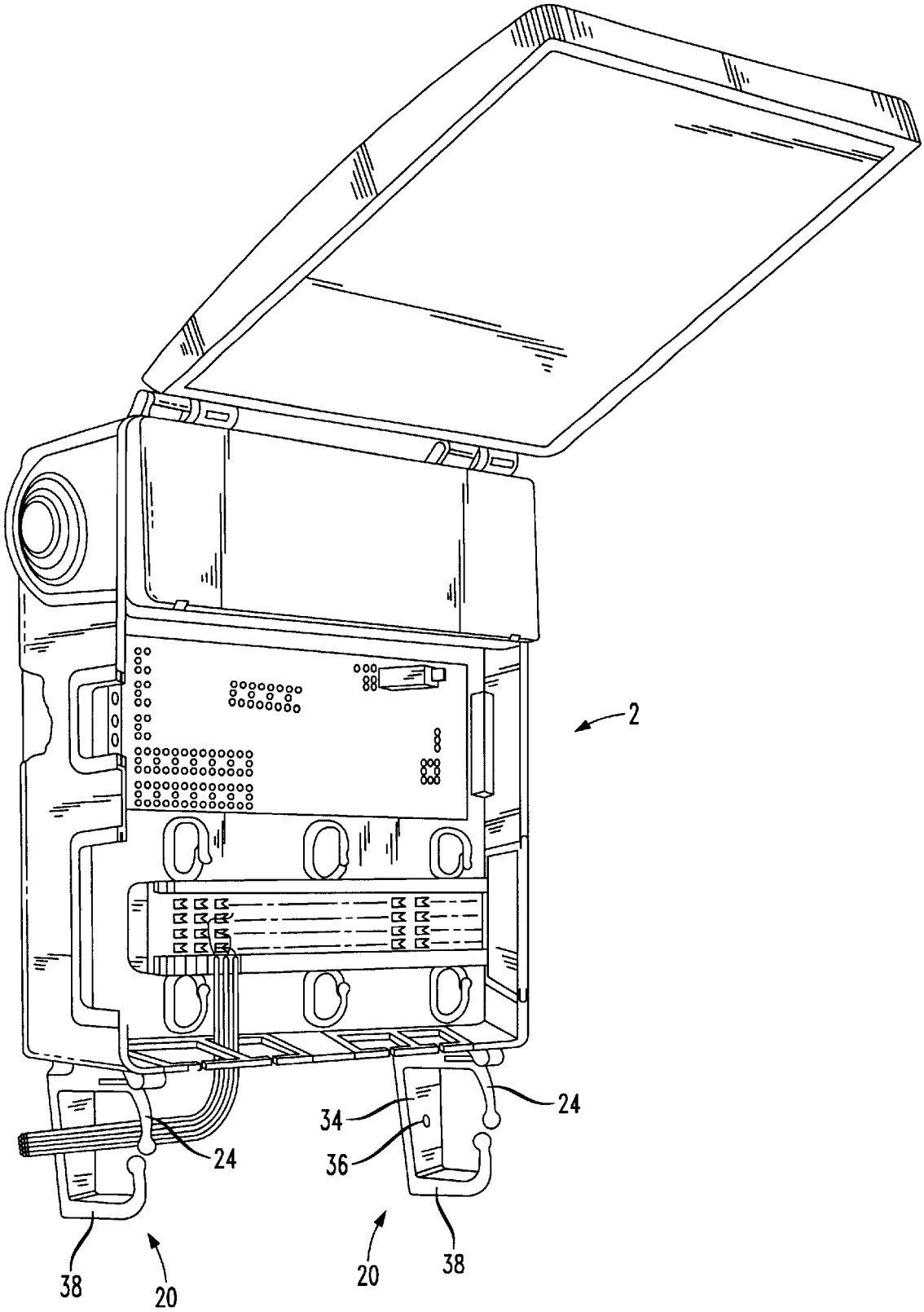
FIG. 7 is a perspective view of a box mounted on a wall with the preferred restraint mechanism of the present invention mounted thereon, said restraint mechanism holding wire exiting from the box.

To aid stability, the restraining arm 24 is attached to a base 34 which can rest against a wall on which the box 2 is mounted. See FIGS. 6 and 7. To further increase stability, the base 34 is preferably secured to the wall by a screw passing through a screw mounting hole 36 in the base, which is then screwed into the wall.

On the side of the base 34 opposite that which the restraining arm 24 is attached, a retention arm 38 preferably extends toward the terminal end of the restraining arm 24 and the hinge 8. The retention arm 38 also preferably includes a radial bend 44 through an arc which is less than 90°, to match with the angle of the end of the arm 24, and terminates in a terminal end 46.

Figure 8:
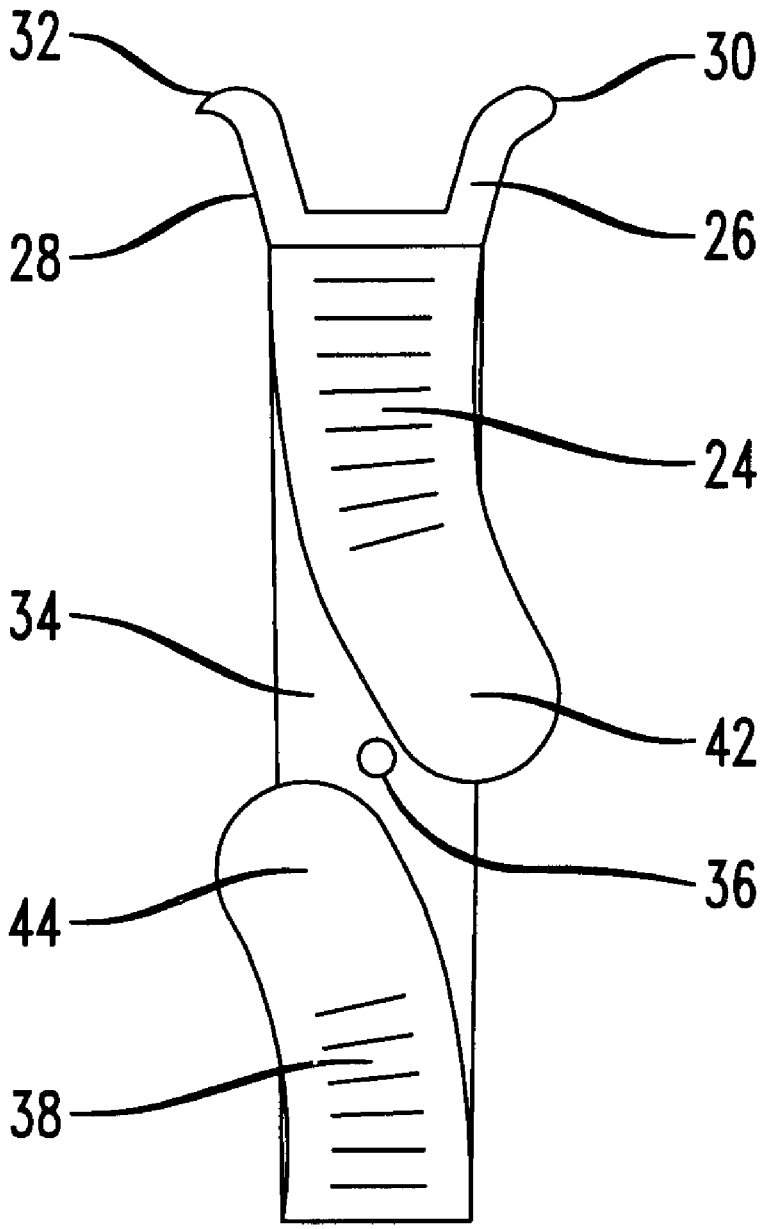
FIG. 8 is a front elevation of the preferred restraint mechanism of the present invention.

The retention arm 38 acts to hold wires exiting from the box 2. See FIG. 7. As such, there is preferably a space between the terminal ends 42 and 46 of the restraining arm 24 and the retention arm 38 to allow a technician to slip wires into the mechanism 20. As best seen in FIG. 8, the terminal ends 42 and 46 are most preferably offset, turning in different lateral directions, to aid in the separation of the terminal ends 42 and 46 to slip a bundle of wires.

It is preferred that the restraint mechanism 20 be formed of unitary construction, preferably injection molded of a high impact plastic material. Suitable materials are polycarbonate or polyvinyl chloride (PVC) with polycarbonate being most preferred.

Variations and modifications to the invention described herein will make themselves apparent to a person skilled in the art reviewing this disclosure. All such variations and modifications are intended to fall within the spirit and scope of the present invention, limited only by the following claims.

I claim:

1. A restraint mechanism for limiting the angular rotation of a first and a second component which rotate about a common hinge axis of a hinge member, said restraint member comprising a restraining arm having at least a first and a second portion including a change of direction from the first to the second portion of a predetermined degree, and an attachment member for attaching the restraint mechanism to one of the components wherein the degree of the change of direction substantially limits the rotation of the components and the restraint mechanism does not attach to the hinge member.

2. The restraint mechanism of claim 1 wherein the restraining arm is flexible to provide some give when the second component is restrained thereby.

3. The restraint mechanism of claim 1 wherein the change of direction of the restraining arm is a radial bend.

4. The restraint mechanism of claim 1 further comprising a base having a first end and a second end, the restraining arm originating from the first end of the base.

5. The restraint mechanism of claim 4 further comprising a retention arm originating from the second end of the base for retaining objects placed on the retention arm.

6. The restraint mechanism of claim 5 wherein the retention arm comprises a change of direction toward said restraining arm.

7. The retention arm of claim 6 wherein the change of direction comprises a radial bend.

8. The restraint mechanism of claim 5 wherein the restraining arm and the retention arm each have a terminal end opposite where they originate from the base, said terminal end of the restraining arm and said terminal end of the retention arm being separated by a space.

9. The restraint mechanism of claim 8 wherein the terminal ends of the restraining arm and the retention arm laterally diverge from one another.

10. The restraint mechanism of claim 1 wherein the attachment members comprises one or more extensions which cooperate with corresponding receivers in the first component.

11. The restraint mechanism of claim 1 wherein the attachment member is flexible for release from the component to provide releasable attachment.

12. The restraint mechanism of claim 1 wherein the restraint mechanism is made of unitary construction.

13. The restraint mechanism of claim 12 wherein the restraint mechanism is made of a polymer.

14. The restraint mechanism of claim 13 wherein the restraint mechanism is made of polycarbonate.

* * * * *